US005481261A

United States Patent [19]

Kanno

[11] Patent Number: 5,481,261

[45] Date of Patent: Jan. 2, 1996

[54] WARNING FOR REMOTE CONTROL SYSTEM

[75] Inventor: Isao Kanno, Hamamatsu, Japan

[73] Assignee: Sanshin Kogyo Kabushiki Kaisha, Hamamatsu, Japan

[21] Appl. No.: 740,045

[22] Filed: Aug. 2, 1991

[30] Foreign Application Priority Data

Aug. 10, 1990 [JP] Japan ..... 2-210228

[51] Int. Cl.[6] ..... B63B 22/00

[52] U.S. Cl. ..... 340/870.16; 74/480 B; 114/144 R; 114/144 E; 114/144 A; 440/7; 440/87

[58] Field of Search ..... 340/870.16, 314, 340/648, 825.69, 825.72; 43/26.1; 74/480 B; 114/144 R, 144 E, 144 RE, 144 A, 149; 180/167, 179; 318/16, 480; 440/1, 6, 7, 87, 113

[56] References Cited

U.S. PATENT DOCUMENTS

| | | | |
|---|---|---|---|
| 2,702,615 | 2/1955 | Morse . | |
| 2,869,861 | 1/1959 | Carlson . | |
| 3,322,994 | 5/1967 | Dever et al. . | |
| 3,644,816 | 2/1972 | Gilbert . | |
| 4,004,537 | 1/1977 | Nilsson . | |
| 4,019,489 | 4/1977 | Cartmill | 440/1 |
| 4,020,713 | 5/1977 | Cantley et al. . | |
| 4,055,135 | 10/1977 | Wesner | 114/144 E |
| 4,079,906 | 3/1978 | Durandeau et al. . | |
| 4,223,624 | 9/1980 | Iyeta . | |
| 4,306,314 | 12/1981 | Griffiths . | |
| 4,342,274 | 8/1982 | Spurgin et al. | 114/144 E |
| 4,513,235 | 4/1985 | Acklam et al. . | |
| 4,527,983 | 7/1985 | Booth . | |
| 4,614,900 | 9/1986 | Young . | |
| 4,708,669 | 11/1987 | Kanno et al. | 440/1 |
| 4,718,869 | 1/1988 | Fisher . | |
| 4,810,216 | 3/1989 | Kawamura . | |
| 4,824,408 | 4/1989 | Aertker et al. . | |
| 4,831,531 | 5/1989 | Adams et al. . | |
| 4,836,809 | 6/1989 | Pelligrino . | |
| 4,914,368 | 4/1990 | Orton . | |
| 4,919,005 | 4/1990 | Schleicher . | |
| 4,920,819 | 5/1990 | Uchida et al. . | |
| 4,980,628 | 12/1990 | Visser | 114/144 E |
| 5,022,370 | 6/1991 | Ferguson et al. | 440/1 |
| 5,029,547 | 7/1991 | Novey . | |
| 5,058,793 | 10/1991 | Neville et al. . | |
| 5,072,361 | 12/1991 | Davis et al. . | |
| 5,080,619 | 1/1992 | Uchida et al. | 440/87 |
| 5,107,424 | 4/1992 | Bird et al. | 114/144 RE |
| 5,136,279 | 8/1992 | Kanno | 440/2 |

*Primary Examiner*—Michael Horabik
*Attorney, Agent, or Firm*—Knobbe, Martens, Olson & Bear

[57] ABSTRACT

A warning system embodied in a remote control system which includes a warning circuit and which alerts the individual operating the system if the position of a controlled member of the system does not correspond with the position of the remote operator of the system within a preset period of time after the operator is moved.

7 Claims, 3 Drawing Sheets

WARNING FOR REMOTE CONTROL SYSTEM

BACKGROUND OF THE INVENTION

This invention relates to a remote control system adapted for a marine propulsion unit, and more particularly to an improved remote control system which includes a warning system which warns the individual operating the system if a controlled member, such as a throttle or transmission control lever on the propulsion unit, does not coincide with the position of the remote operator of the remote control system within a set period of time after the remote operator is moved.

One type of remote control arrangement has been proposed which is employed on certain water craft to electrically operate a controlled member on an associated marine propulsion unit. With this type of arrangement, movement of a remote operator effects movement of the controlled member through an electric actuator which is powered by a storage battery on the water craft. A detection-control system is provided which controls the actuator so that the detected position of the remote operator and controlled member normally correspond. While this type of arrangement has the advantage of reducing the operational load normally associated with purely mechanically operated remote control systems, it has certain disadvantages as well. For example, the location of the remote operator and the fact that it is electrically connected to the controlled member may make it difficult for the individual operator to visually determine if the remote operator and controlled member are out of alignment. In addition, no means are provided for alerting the individual operator if the present position of the controlled member differs from the present position of the remote operator which may occur, for example, as a result of foreign matters becoming lodged between moving members of the system. Such a discrepancy may also occur as a result of battery or electrical component failure.

It is, therefore, a principal object of this invention to provide an improved remote control system for a marine propulsion unit which includes electric actuating means for actuating a controlled member on the propulsion unit under normal circumstances, and which further includes warning means to inform the individual operating the system if the controlled member of the propulsion unit does come into alignment with the remote operator within a particular period of time after movement of the operator.

SUMMARY OF THE INVENTION

This invention is adapted to be embodied in a remote control system for transmitting control movement to a controlled element and which includes a controlling unit and a remote control unit having an operator movable between a plurality of positions. The system further includes means for detecting the position of the operator and outputting a signal to the controlling unit indicative of the detected position of the operator, as well as means for detecting the position of the controlled element and outputting a signal to the controlling unit indicative of the detected position of the controlled element. An actuator unit is provided which includes electric actuating means for actuating the controlled element on the basis of the signals received by the controlling unit. In accordance with the invention, the remote control system includes warning means which preferably comprises a warning circuit embodied in the controlling unit and which generates a warning signal if the detected position of the controlled element does not correspond with the detected position of the operator after the operator is moved.

DETAILED DESCRIPTION OF THE PREFERRED EMBODIMENT OF THE INVENTION

Figure 1:
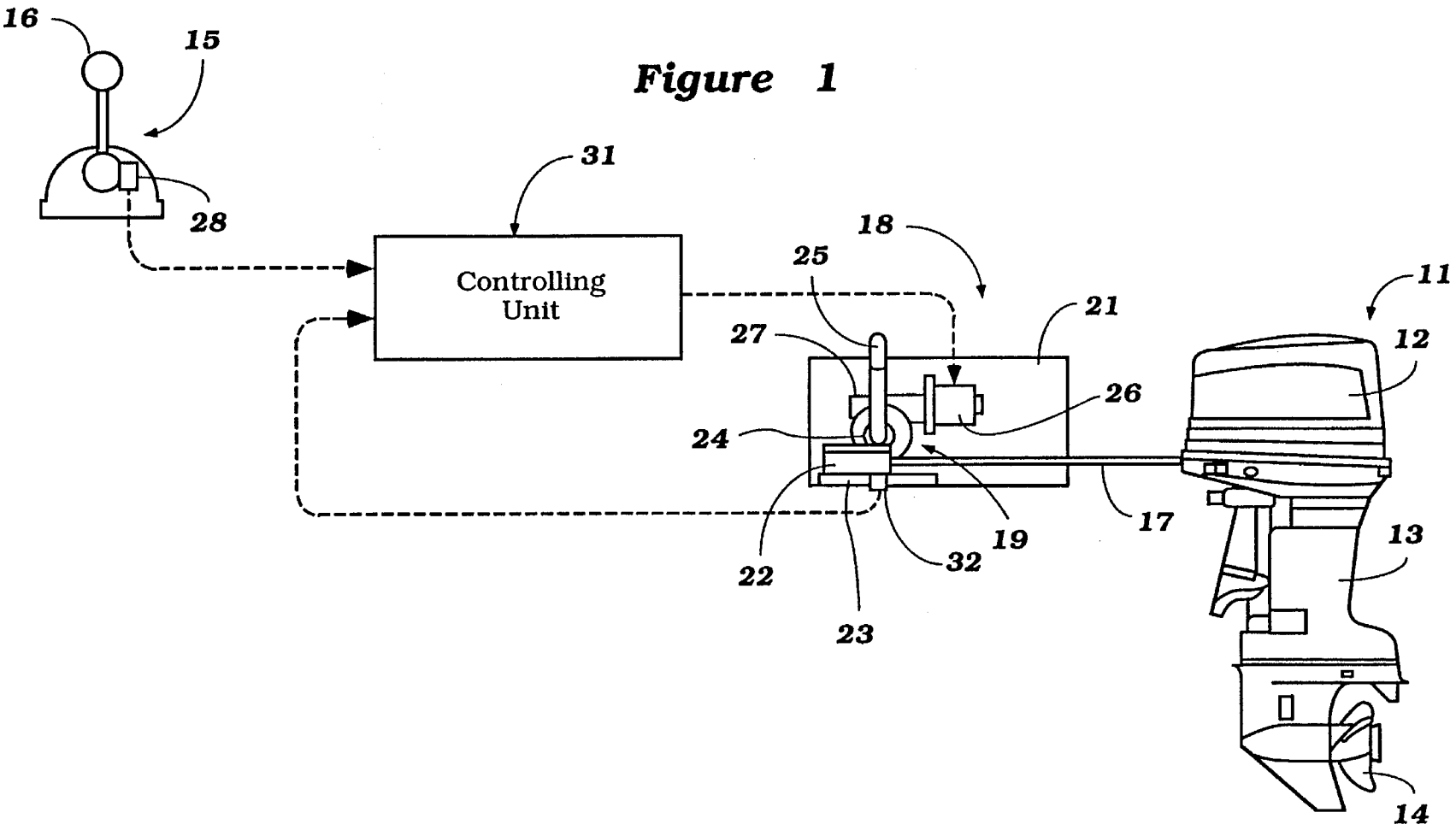
FIG. 1 is a partially perspective and partially schematic view of the remote control system constructed and operated in accordance with an embodiment of the invention.

Referring first to FIG. 1, a remote control system for operating a marine propulsion unit from a remote location is depicted. In the illustrated embodiment, the marine propulsion unit, which is identified generally by the reference numeral 11, comprises an outboard motor. However, it should be noted that the marine propulsion unit 11 may alternatively comprise the outboard drive portion of an inboard/outboard drive unit.

In the illustrated embodiment, the marine propulsion unit 11 includes a power head 12 that contains an internal combustion engine (not shown) and which is surrounded by a protective cowling. The internal combustion engine drives an output shaft which, in turn, drives a driveshaft that is journaled for rotation within a driveshaft housing 13 that depends from the power head 12. This driveshaft (not shown) drives a propeller 14 of a lower unit by means of a conventional forward, neutral, reverse transmission of the type normally used with such propulsion units and which may be operated in accordance with an embodiment of the invention.

A remote control unit 15, comprised of an operator 16 pivotally mounted on a base, is provided for controlling either a throttle or transmission control lever on the marine propulsion unit 11 and is preferably positioned on the bridge of an associated water craft near the other controls of the water craft. If the remote control unit 15 is used to control throttle operation, the operator 16 will be movable between an idle position and a fully open throttle position. If, on the other hand, the remote control unit 15 is used to control the transmission, the operator 16 will be movable between neutral, forward and reverse positions. The remote control unit 15 may also be adapted to control both the transmission and throttle of the propulsion unit 11. In the illustrated embodiment, the remote unit 15 is used to control either transmission or throttle of the propulsion unit 11.

A cable 17 is connected at one end to the throttle or transmission control lever and is connected at the other end to an electromotive actuator unit 18 for actuation of the lever. This actuator unit 18 comprises electric actuating means 19 as well as manual actuating means for controlling movement of the lever and thus for controlling the throttling or transmission of the marine propulsion unit 11. The actuator unit 18 and its associated components are contained within a casing 21.

The cable 17 has a bowden wire which is connected at one end to the control lever and at its other end to a slide rack 22 which is slidably supported on a base 23 and which together with the control lever forms the controlled element. The rack 22 has teeth that are enmeshed with an pinion gear 24 (see FIG. 2) which is rotatably journaled upon a shaft and which is also journaled to a manual lever 25 of the manual actuating means. An electric motor 26 is coupled to the shaft through a reduction gear box assembly 27 and is operated to drive the shaft and effect movement of the control lever on the propulsion unit 11 under normal conditions and in a manner to be described.

Figure 2:
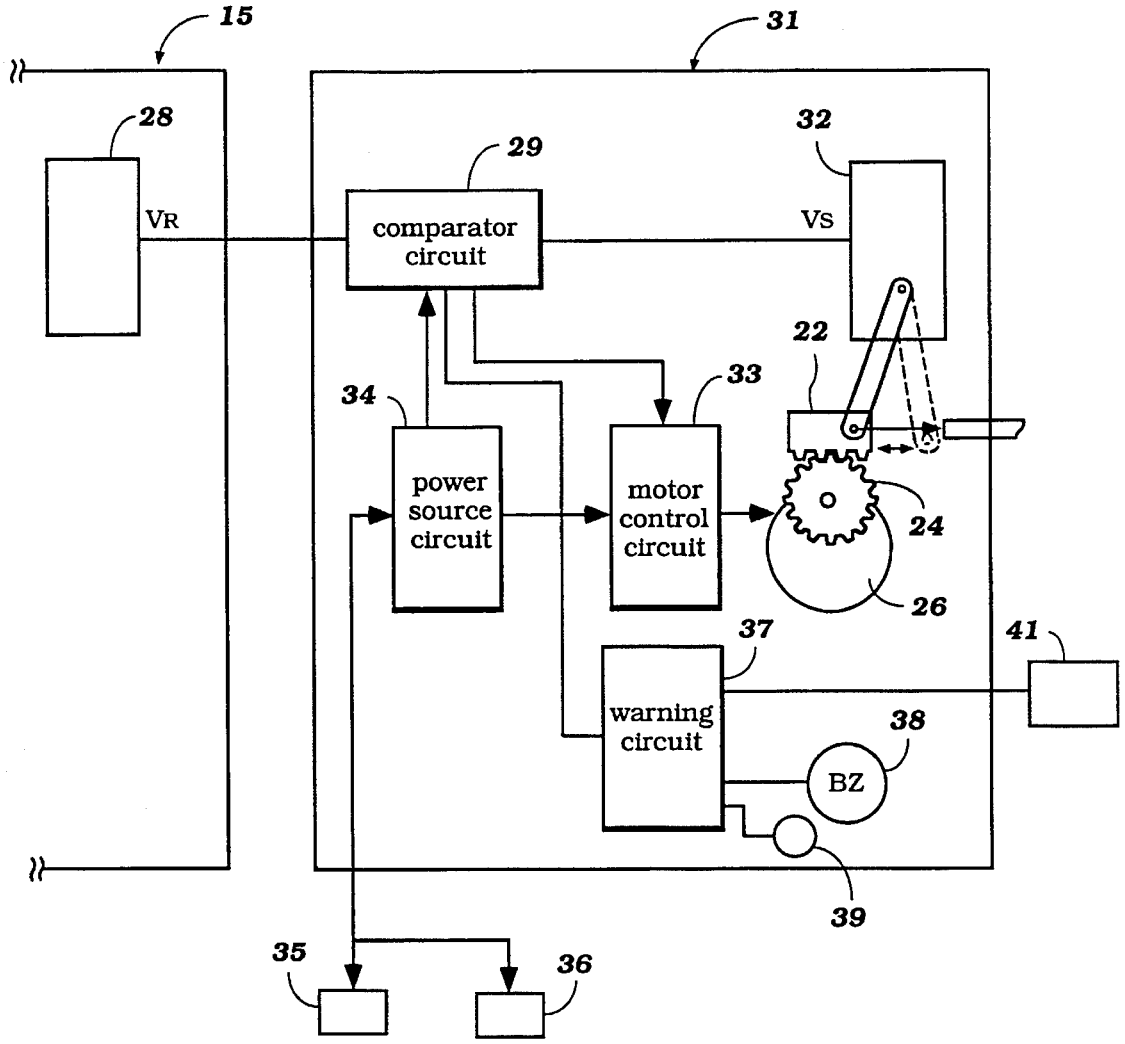
FIG. 2 is a schematic view of the remote control system showing the warning circuit embodied in the controlling unit.

Referring now to FIG. 2, in addition to FIG. 1, when the electric actuating means 19 is used to control movement of the throttle or transmission control lever, a control position detector 28 positioned in proximity to the remote control unit 15 detects the position of the operator 16 as it is moved and transmits an electrical signal indicative of this detected position to a comparator circuit 29 of a controlling unit, indicated generally by the reference numeral 31. Upon movement of the operator 16, this comparator circuit 29 also receives an electrical signal from a detector 32 which detects the position of the slide rack 22 through rotation of an arm which is pivotally linked between the detector 32 and the slide rack 22. This electrical signal outputted by the detector 32 is indicative of the detected position of the slide rack 22 and thus the position of the throttle or transmission control lever on the propulsion unit 11 which, as previously noted, is mechanically linked to the slide rack 22 via the cable assembly 17.

In operation, the comparator circuit 29 compares the signals received from the detectors 28 and 32 and outputs a difference signal to a motor control circuit 33 which, in turn, outputs a signal to the electric motor 26 for controlling its operation to null the difference signal. That is, upon receipt of this difference signal, the electric motor 26 is operated so that the present position of the slide rack 22 and hence the transmission or throttle control lever corresponds with the present position of the operator 16.

When the motor 26 is operated in this manner under normal conditions, it drives the shaft and pinion gear 24. Movement of the pinion gear 24 causes the slide rack 22 to slide along its base 23 to effect a push-pull movement on the bowden wire of cable 17 so as to effect movement of the transmission or throttle control lever until the position of the lever corresponds with the position of the operator 16. When the pinion gear 24 and manual lever 25 are engaged with the shaft, as is the case in the electric actuating mode, the manual lever 25 will also move in response to operation of the electric motor 26 and shaft so as to give a visual indication of the position of the throttle or transmission control lever.

The controlling unit 31 further includes a power source circuit 34 which provides power to the comparator circuit 29 and to the motor control circuit 33. The power source circuit 34 is in circuit with a battery 35 and a generator 36 equipped on the engine.

In accordance with the invention, the controlling unit 31 is also provided with a warning circuit, identified by the reference unit 37. This warning circuit 37 is in circuit with the comparator circuit 29 and receives an electrical signal from that circuit 29 when the detected position of the slide rack 22 and controlled member do not come into correspondence with the detected position of the operator 16 after the operator 16 is moved. The warning circuit 37 is equipped with an internal timer and if there is still no correspondence between the controlled element and the operator 16 within a predetermined period of time after the operator 16 is moved, the warning circuit 37 transmits an electrical signal to a buzzer 38 and an indicator light 39 which are activated to generate an audio and a visual warning signal respectively to alert the water craft operator that the remote control system is out of alignment. If there is no correspondence between the controlled element and the operator 16 within the preset period of time after the operator 16 is moved, the warning circuit 37 also outputs an electrical signal to a spark control circuit 41 which reduces the engine speed until the system is realigned.

It should be noted that the system may also be adapted for manual operation of the throttle or transmission control lever should that become necessary due to an electrical system failure. To this end, a clutch assembly is provided for selectively engaging and disengaging the pinion gear 24 and manual lever 25 with the shaft, electric motor 26 and gear box 27. The pinion gear 24 and manual lever 25 may be joined together to form a single unit so as to engage and disengage with the shaft as such. This clutch assembly typically includes a latch which is slidably movable within a longitudinal recess of the manual lever 25 and which has a latch knob that is received within a larger diameter opening formed in the underside of a handle of the manual lever 25. A coil compression spring may be interposed between the latch knob and the manual lever handle and held axially in position at its lower end by an opening formed in the latch knob and at its upper end by a smaller diameter opening which extends upwardly from the larger diameter opening in the handle. The coil compression spring acts to bias the latch into engagement with a pin of the shaft so as to normally engage the pinion gear 24 with the electric motor 26 and gear box 27. As a result of this clutch mechanism, the pinion gear 24 can be rotated by the shaft, or by the manual lever 25 independently of the shaft, to effect movement of the controlled element.

To manually operate the control lever, the operator of the water craft grasps the handle of the manual lever 25 and urges the latch upward so that it becomes disengaged with the shaft pin. This will free the pinion gear 24 and lever 25 from the resistance of the motor 26 and gear box 27. As a result, only a small force need be applied to the lever 25 to move it forward or backward within a slot formed in the casing 21 in order to manually effect movement of the slide rack 22 and the throttle or transmission control lever.

Figure 3:
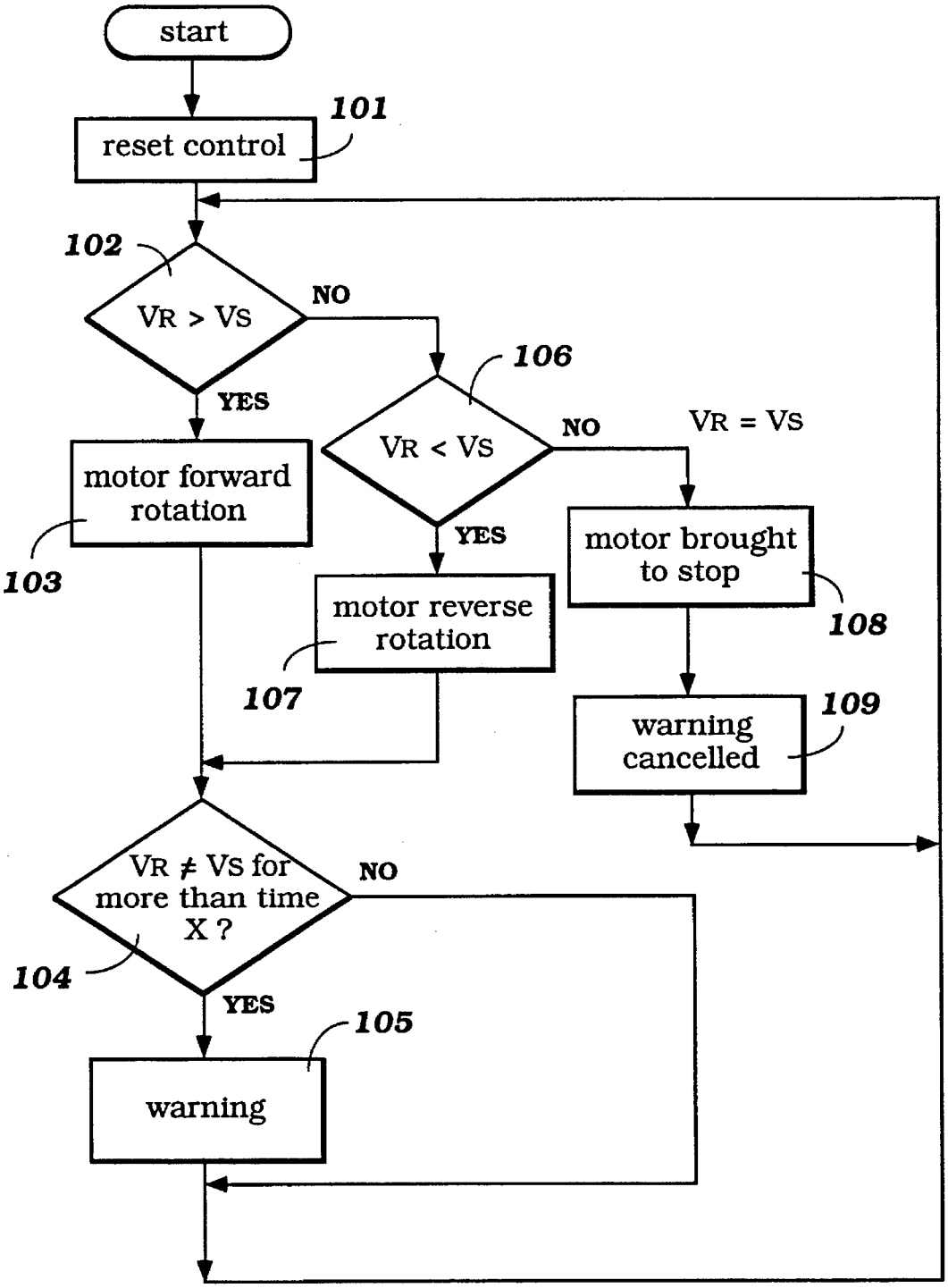
FIG. 3 is a flow chart showing the operation of the remote control system in the electric operating mode.

FIG. 3 is a flow chart showing the operation of the remote control system in the electric operating mode. At the outset of the program, the operator 16 is moved or reset to initiate transmission shift or throttle operation control (step 101). Upon movement of the operator 16, the comparator 29 compares the signal $V_R$ outputted by the control position detector 28 with the signal $V_S$ outputted by the controlled element detector 32 (step 102). If $V_R$ is greater than $V_S$, the comparator 29 outputs a signal to the motor control circuit 33 for forward rotation of the motor 26 (step 103). Following that operation of the motor 26, it is determined if $V_R$ is unequal to $V_S$ for more than a predetermined time X (step 104). If yes, then the warning circuit 37 outputs signals to the warning buzzer 38 and warning light 39 to generate the warning signals (step 105). If no, then the program repeats.

Referring back to step 102, if $V_R$ is not greater than $V_S$, the program proceeds to step 106 where it is determined if $V_R$ is less than $V_S$. If $V_R$ is less than $V_S$, the comparator 29 outputs a signal to the motor control circuit 33 for reverse rotation of the motor 26 (step 107). After that operation of the motor 26, the program proceeds to step 104 and continues as previously described.

If at step 106 it is determined that $V_R$ is not less than $V_S$ but that they are equal, the motor 26 is not operated (step 108), and the warning timer is reset or cancelled (step 109). At this point, the program repeats.

From the foregoing description it should be readily apparent that the described remote control system is extremely effective in controlling a controlled member such as a throttle or transmission control lever from a remote location under various conditions and for alerting the individual operator of certain abnormalities in the system. The system is adapted for electric control and is arranged so that when such control is employed the positions of the controlled member and operator will normally correspond. However, in the event that they do not correspond, the system is designed to warn the operator of this discrepancy so that it may be readily corrected. Although embodiments of the invention have been illustrated and described, various changes and modifications may be made without departing from the spirit and scope of the invention, as defined by the appended claims.

I claim:

1. A remote control system for transmitting control movement to a controlled element comprising, a controlling unit, a remote control unit having an operator movable between a plurality of positions, first means for detecting the position of said operator and outputting a signal to said controlling unit indicative of the detected position of said operator, second means for detecting the position of said controlled element and outputting a signal to said controlling unit indicative of the detected position of said controlled element, an actuator unit including electric actuating means for actuating said controlled element on the basis of the signals received,by said controlling unit, and a warning circuit having a timer for generating a warning signal if the detected position of said controlled element does not correspond with the detected position of said operator within a predetermined period of time after said operator is moved.

2. A remote control system as recited in claim 1, wherein said controlling unit comprises a comparator for comparing the signals received from said first and second detecting means and outputting a difference signal to said electric actuating means for controlling its operation to null the difference signal.

3. A remote control system as recited in claim 1, wherein said actuator unit further includes manual actuating means for manually actuating said controlled element.

4. A remote control system as recited in claim 1, further comprising an engine and a spark control circuit, wherein, if the detected position of said controlled element does not correspond with the detected position of said operator within the predetermined period of time after said operator is moved, said warning circuit outputs a signal to said spark control circuit for reducing the engine speed.

5. A remote control system for transmitting control movement to a controlled element of a marine propulsion unit having an engine comprising, a controlling unit, a remote control unit having an operator movable between a plurality of positions, first means for detecting the position of said operator and outputting a signal to said controlling unit indicative of the detected position of said operator, second means for detecting the position of said controlled element and outputting a signal to said controlling unit indicative of the detected position of said controlled element, an actuator unit including electric actuating means for actuating said controlled element on the basis of the signals received by said controlling unit, warning means including a warning circuit having a timer for generating a warning signal if the detected position of said controlled element does not correspond with the detected position of said operator within a predetermined period of time after said operator is moved, and a spark control circuit wherein, if the detected position of said controlled element does not correspond with the detected position of said operator within the predetermined period of time after said operator is moved, said warning circuit outputs a signal to said spark control circuit for reducing the engine speed.

6. A remote control system as recited in claim 5, wherein said controlling unit comprises a comparator for comparing the signals received from said first and second detecting means and outputting a difference signal to said electric actuating means for controlling its operation to null the difference signal.

7. A remote control system as recited in claim 5, wherein said actuator unit further includes manual actuating means for manually actuating said controlled element.

* * * * *